United States Patent [19]

White

[11] Patent Number: 4,876,877

[45] Date of Patent: Oct. 31, 1989

[54] PORTABLE TOOL FOR BENDING ROOF BOLTS FOR INSERTION IN MINE ROOF OPENINGS

[75] Inventor: Claude C. White, Birmingham, Ala.

[73] Assignee: Birmingham Bolt Company, Inc., Birmingham, Ala.

[21] Appl. No.: 206,362

[22] Filed: Jun. 14, 1988

[51] Int. Cl.[4] ..... B21D 9/07

[52] U.S. Cl. ..... 72/388; 72/387; 72/453.15; 72/453.16

[58] Field of Search ..... 72/387, 388, 435.15, 72/453.16

[56] References Cited

U.S. PATENT DOCUMENTS

| | | | |
|---|---|---|---|
| 3,613,430 | 7/1969 | Crees | 72/388 |
| 3,786,668 | 1/1974 | Crees | 72/388 |
| 4,537,052 | 8/1985 | Adleman | 72/388 |

FOREIGN PATENT DOCUMENTS

| | | | |
|---|---|---|---|
| 1408577 | 7/1965 | France | 72/387 |
| 0662199 | 5/1979 | U.S.S.R. | 72/388 |

*Primary Examiner*—David Jones

*Attorney, Agent, or Firm*—Shlesinger & Myers

[57] ABSTRACT

A portable tool for bending elongated mine roof bolts in situ including a stationary support portion for holding a part of a roof bolt, a movable support portion for holding another part of the roof bolt, a power cylinder and piston for moving the movable support portion in an arc to effect bending one end of the bolt, to permit insertion thereof into a mine roof opening. The power cylinder and piston being activated to return the movable support portion to its initial position, thereby straightening the bolt to permit full insertion of the bolt into the mine roof opening.

7 Claims, 3 Drawing Sheets

PORTABLE TOOL FOR BENDING ROOF BOLTS FOR INSERTION IN MINE ROOF OPENINGS

This invention is a portable tool for bending elongated mine roof bolts in situ for inserting the same in mine roof openings, and then straightening the bolts to permit full insertion of the bolt into the opening.

BACKGROUND OF THE INVENTION

Roof bolts are conventionally installed vertically in mine roof openings to support the mine roof. When, for safety's sake, a bolt must be used which is longer than the height of the mine passage, the bolt must first be bent in order to insert the upper end thereof into the mine roof opening. After partial insertion in the opening, the bent bolt must then be straightened to permit full insertion of the bolt into the opening, following which the bolt is rotated to anchor it by mechanical anchors or resin.

In the past, the bending and straightening of roof bolts have been carried out manually in a laborious and slow procedure which has resulted in many injuries to workers including back strains and falls caused by the worker's feet slipping off the rods while bending them.

More recently, the bolts have been notched at the point they are to be bent, which increases the cost of manufacture thereof. Although notching reduces the force necessary to bend the bolt, the notches also weaken the bolts by as much as 40%, thereby considerably increasing the danger that roof fall will occur due to breakage of the bolt at the location of the notch.

SUMMARY OF THE INVENTION

The present invention is a portable, lightweight tool for mechanically bending an elongated mine roof bolt in situ within a mine, for partial insertion thereof in a mine roof opening, followed by mechanical straightening of the elongated bolt for full insertion thereto into the opening.

The tool comprises a stationary support portion on which a part of the bolt is supported, a movable support portion pivotally engaged, and axially aligned, with the stationary support portion. Power means are engaged with the movable support portion and, upon actuation, effects movement of the latter angularly to the stationary support portion, to effect bending of the elongated bolt at an angle approaching a right angle to the remainder of the bolt. After insertion of the bolt into the bore hole opening, the power means is reversed to return the movable section to its original position in axial alignment with the stationary support portion, thereby straightening the bolt and allowing it to be fully inserted into the mine roof opening.

The power means of the present tool is preferably a hydraulic cylinder which is operatively engaged with the hydraulic system of a conventional roof bolting machine used in the installation and tightening of the roof bolt in the mine roof. The tool is provided with a handgrip to facilitate carrying the tool from one installation site to another, and for holding the same during the bolt bending and straightening operations.

The present tool may also be connected to a jack and more particularly to the vertically movable lifting portion of a conventional automobile bumper type jack to facilitate insertion of the bent portion thereof into the mine roof opening.

The portable tool of the present invention enables miners to bend roof bolts much faster than by hand, and with little physical effort. It also permits unnotched bolts to be employed, thereby reducing the cost of manufacture and permits the use of a bolt having no weakness along the length of the bolt which could result in failure thereof.

DETAILED DESCRIPTION OF THE INVENTION

Figures 1, 2, 3:
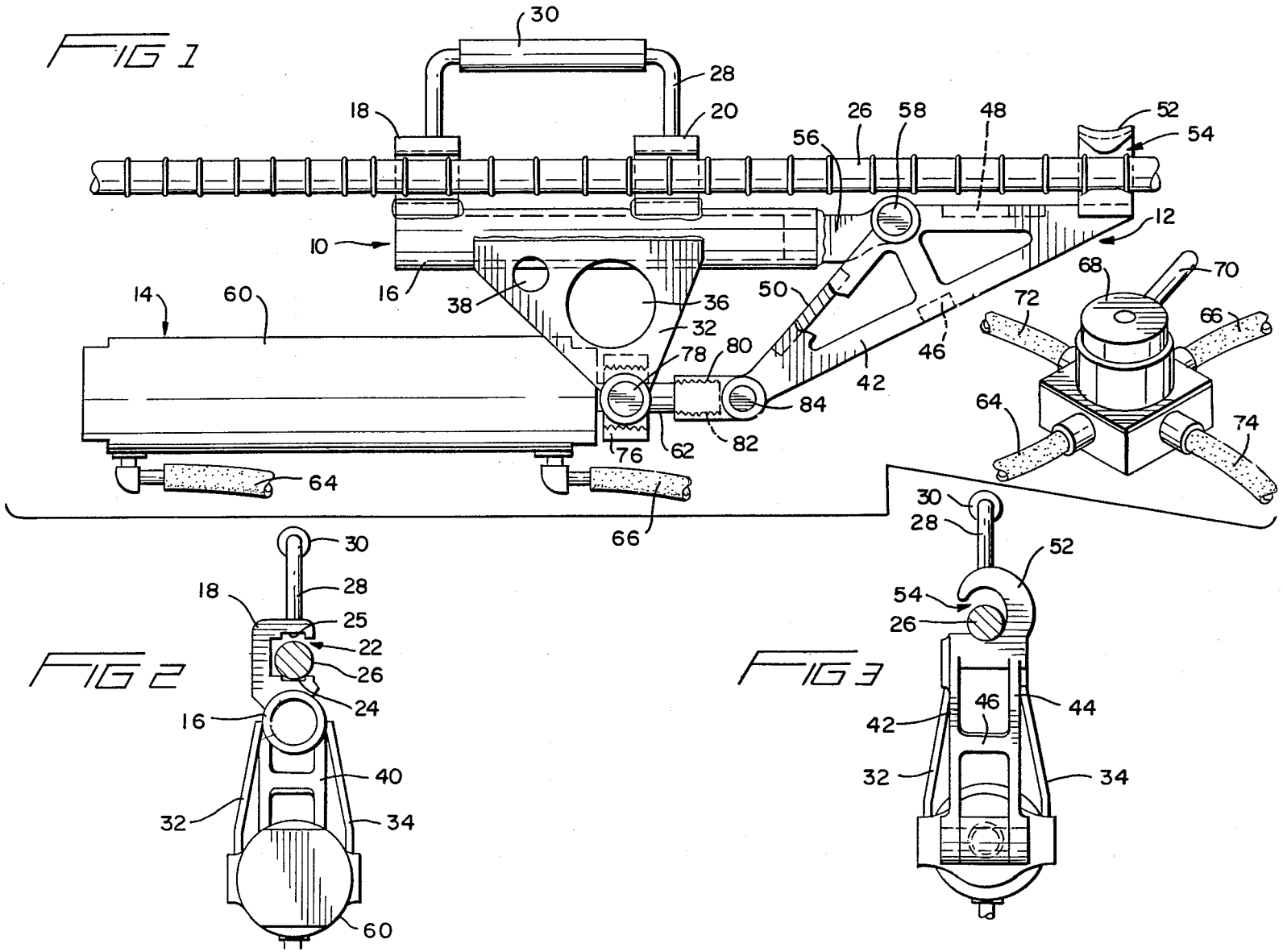
FIG. 1 is a side elevational view of the portable bending tool of the present invention in inoperative position.
FIG. 2 is an end elevational view of the present invention as viewed from the left end of FIG. 1.
FIG. 3 is an end elevational view of the present invention viewed from the right end of FIG. 1.

The tool of the present invention generally includes a bolt support which comprises a stationary portion 10 and a movable support portion 12 which is actuated by a power cylinder 14.

Stationary support portion 10 comprises a tubular member 16 to the upper surface of which is affixed in any suitable manner a pair of spaced, generally C-shaped bolt retaining members 18 and 20.

As shown to advantage in FIG. 2, each C-shaped member 18 and 20 is provided with an inwardly directed recess 22, shown to advantage in FIG. 2, the lower and upper portions thereof being notched at 24 and 25 to facilitate holding an elongated roof bolt 26 therein.

The terminals of an inverted U-shaped member 28 extend upwardly from spaced C-shaped members to form a handgrip, the transverse portion of the U-shaped member being enlarged at 30 to facilitate gripping of the tool.

As shown to advantage in FIGS. 1 and 2, a pair of like, connecting arms 32 and 34 extend downwardly from opposed sides of tubular member 16 to power means 14. Connecting arms 32 and 34 are generally flat, triangular shape, portions thereof being cut out at 36 and 38 to reduce weight.

An H-shaped brace 40 extends between tubular member 16 and power means 14 between connecting arms 32 and 34.

Movable support portion 12 includes a pair of spaced reticulate triangular shaped members 42 and 44 which are in substantially parallel relationship to each other, the base and sides of which are joined by a plurality of connectors 46, 48 and 50.

A C-shaped member 52 is fixed to triangular shape members 42 and 44 adjacent the outer end of member 42, as viewed in FIG. 1. Member 52 is provided with a recess 54 for receiving a part of elongated bolt 26, and to retain the same in engagement with the tool during the bending operation.

A tubular arm 56 extends from one end of tubular member 16, and the outer end thereof terminates in a tubular portion through which a pin 58 extends for pivotally connecting the arm to movable support portion 12 at the juncture of the sides of triangular shaped members 42 and 44.

Power cylinder 14 preferably comprises a hydraulic cylinder 60 having a piston 62 extending from one end thereof. Hydraulic supply lines 64 and 66 extend from hydraulic cylinder 60 to a standard control valve 68 having an operating lever 70. Valve 68 in turn is connected through supply lines 72 and 74 to a hydraulic source such as the pump and reservoir of a conventional bolting machine used for installing roof bolts in mines.

A bearing block 76 is fixedly engaged in any suitable manner with the forward end of hydraulic cylinder 60, and the lower ends of triangular connectors 34 and 36 are bolted to block 68, as indicated at 78.

The outer end of hydraulic piston 62 is connected to a boss 80 having an internally threaded opening with which the terminal portion of piston 62 is threadedly engaged at 82. The one end of boss 80 extends between triangular shaped members 42 and 44 at the juncture of one side and the base of, and is connected thereto by means of a bolt 84 which extends through aligned openings in boss 80 and spaced triangular shaped members 42 and 44. This permits pivotal movement of movable support portions 12 with respect to stationary support portion 10 upon extension and retraction of piston 62.

OPERATION

In use of the portable tool of the present invention, hoses 64 and 66 of hydraulic cylinder 60 are connected to the pump and reservoir of a hydraulic supply source, such as a mine roof bolting machine. An elongated bolt 26 is next inserted into the tool from a position laterally thereof by passing the bolt through recesses 22 of C-shaped members 18 and 20 of the stationary support portion and recess 54 of C-shaped member 52 of movable support portion 12.

Enlarged handgrip 30 is then held by one hand and control lever 70 of valve 68 is thrown in a direction to effect movement of piston shaft 62 to an extended position.

Figure 4:
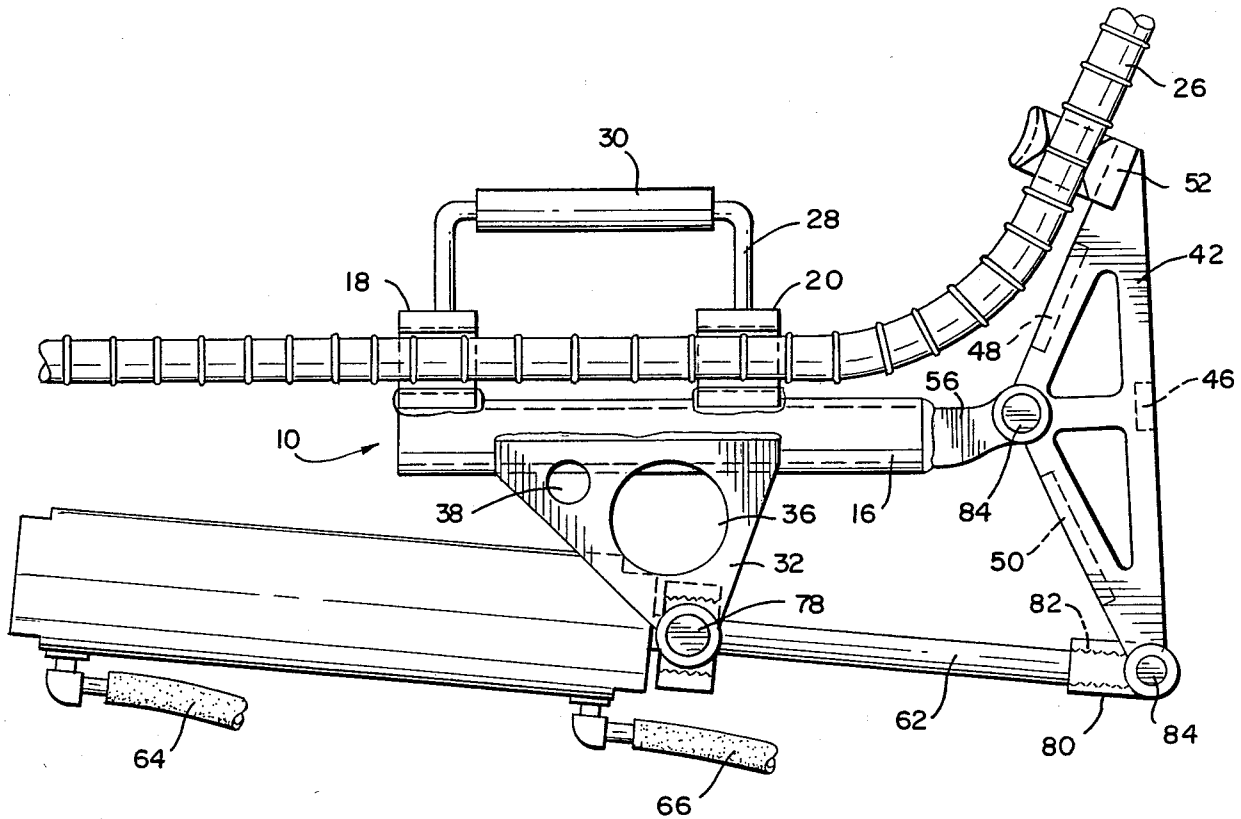
FIG. 4 is a view similar to FIG. 1, showing the tool in operative position.

As shown in FIG. 4, this effects a swinging movement of movable support section 12 to effect a corresponding movement of C-shaped member 52 in an arc, with resultant bending of bolt 26 in an upward direction to permit insertion of the upper end of the bolt into the mine roof opening.

After the upper end of the bolt has been inserted into the opening, operating lever 70 is thrown in a direction to effect retraction of piston shaft 62, thereby straightening bolt 26 to its original shape. The tool is then removed from the bolt by removing the bolt from recesses 22 of C-shaped members 16 and 18 and recess 54 of C-shaped member 52, following which the bolt is pushed upwardly into the mine roof opening until it is fully inserted therein. The bolt may then be tightened in conventional fashion.

Figure 5:
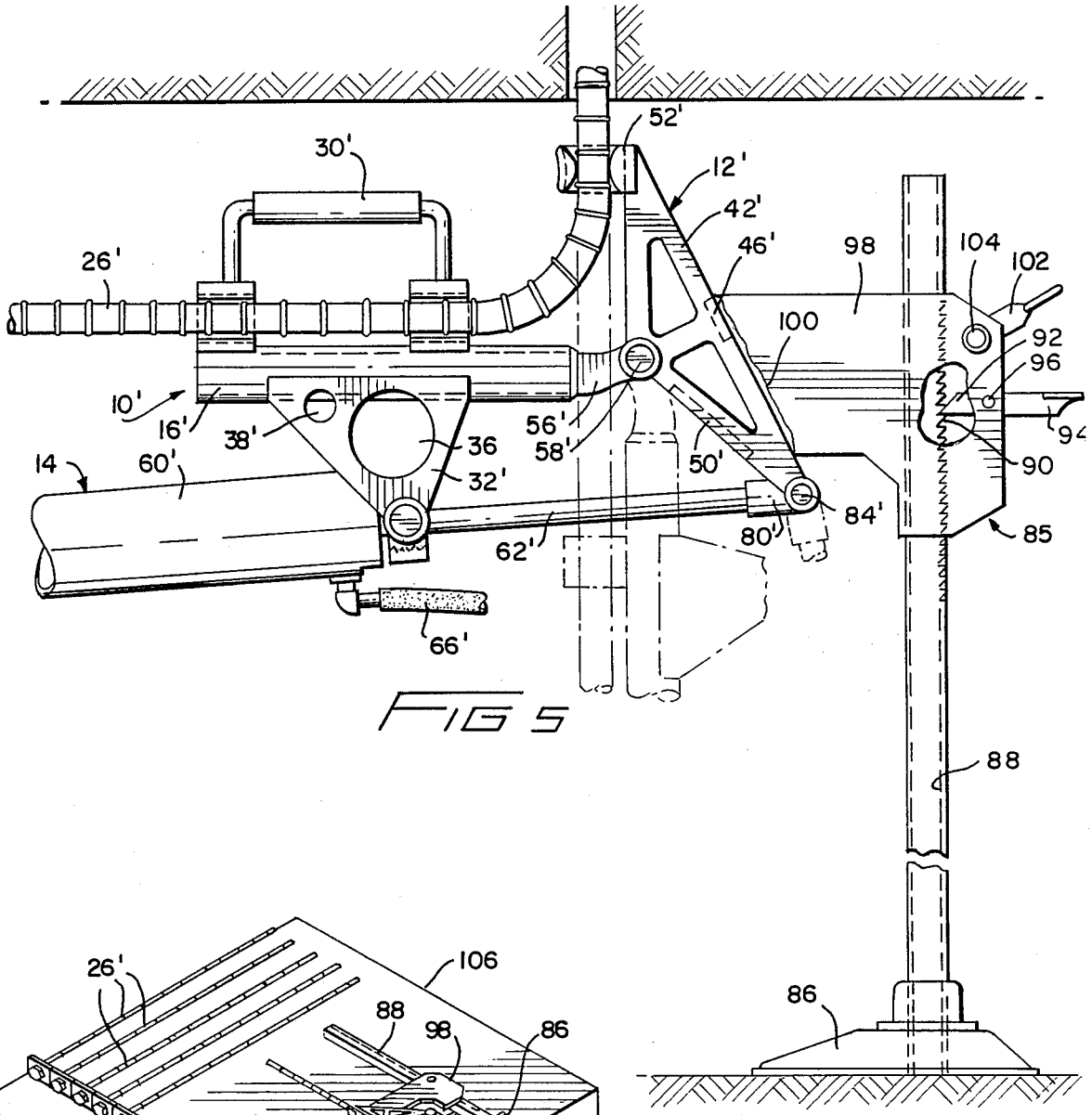
FIG. 5 is a side elevational view of a modified form of the present invention showing the tool in operative position.
Figure 6:
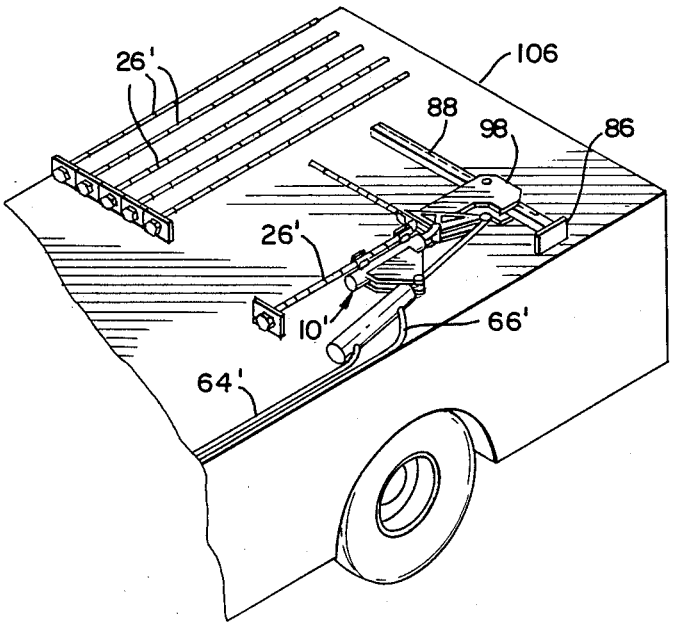
FIG. 6 is a fragmentary perspective view of a bolting machine used for supporting the form of invention illustrated in FIG. 5.

In FIGS. 5 and 6 there is shown a modified form of the present invention which is basically the same as the form of invention illustrated in FIGS. 1 and 4 and parts thereof in this form of the invention are accordingly identified by like, primed numbers.

In this form of the invention, there is provided a jack 85 of the automobile bumper jack type which includes a base 86 which supports an upright stanchion 88, one side of which is provided with a ratchet bar 90 selectively engaged by a tooth 92 of a locking member 94 which is pivotally connected at 96 to lifting portion 98 of the jack. A lateral extremity of lifting portion 98 is welded or secured in any other suitable manner to the base of triangular shaped members 42' and 44', as indicated at 100. A conventional release member 102 is pivoted to lifting portion 98 at 104 for disengaging tooth 92 from ratchet bar 90.

In use of the form of invention illustrated in FIGS. 5 and 6, the present tool is mounted in a rack on the deck of the roof bolting machine 106, with hydraulic supply lines 64' and 66' connected to the pumps and reservoir of the bolting machine. As shown, bolts may be bent while the tool is in the rack on the roof bolting machine. However, the bolts will usually be bent with the tool in the hands of the bolter.

When it is desired to insert a bolt into a mine roof opening, the bolt, which has been bent in the same manner as shown in the form of invention of FIGS. 1 to 4, is inserted into the mine roof opening as in the main form of the invention. However, in order to facilitate insertion into the mine roof opening, the base 86 of the jack is placed on the ground and lifting portion 98 is slid upwardly by hand on stanchion 88, thereby effecting insertion of the bolt into the mine roof opening in the manner discussed above in connection with the form of invention illustrated in FIGS. 1 to 4.

The operating lever of the hydraulic valve is then actuated in a direction to effect movement of movable support portion 12' in a direction to straighten the bolt. This effects a corresponding swinging movement of the tool about pivot pin 58', as shown in dotted lines in FIG. 5.

The tool of the present invention is of simple, lightweight construction, thereby enabling the same to be readily used by unskilled workers, and permits installation of mine roof bolts which must be bent prior to insertion in mine roof openings, quickly and without the physical exertion of the worker which has heretofore been necessary to accomplish this task.

The present invention further enables unnotched bolts to be employed for this purpose, resulting in a reduction in cost of manufacture and providing a bolt which is stronger, and therefore not susceptible to failure when in use.

While there has herein been shown and described the presently preferred forms of this invention, it is to be understood that such has been done for purposes of illustration only, and that various changes may be made therein within the scope of the appended claims.

What is claimed is:

1. Apparatus for bending elongated roof bolts preparatory to insertion thereof into mine roof openings, said apparatus including (a) a stationary support portion for holding a first part of an elongated roof bolt in a substantially horizontal plane;

(b) said stationary support portion comprising a rectilinear member, elongated in a direction parallel with the elongated roof bolt;

(c) a spaced bolt retaining member fixedly connected with said elongated rectilinear member for holding the bolt;

(d) a power cylinder and piston connected to said elongated rectangular member;

(e) a pivotally movable support portion axially aligned with said stationary support portion;

(f) said movable support portion including a triangular shaped member having sides and a base;

(g) a bolt retaining member fixedly connected with one side of said triangular shaped member;
(h) a first means for pivotally connecting said triangular shaped member, at the juncture of the sides thereof, to said elongated rectilinear member;
(i) a second means pivotally connecting said piston with said triangular shaped member at the juncture of one of the sides and the base thereof, and
(j) control means operatively connected with said cylinder and piston, said control means being actuated to a first position to move the piston to extended position, to effect rotational movement of said triangular shaped member and movable support portion in a vertical plane to effect bending of the bolt in an upward direction for insertion of the bent portion of the bolt into the mine roof opening;
(k) said control means being moved to a second position to effect rotational movement of said triangular shaped member and movable support portion to its initial position, to effect straightening of the bolt to permit full insertion thereof into the mine roof opening.

2. The apparatus of claim 1, wherein
(a) said bolt retaining member for said stationary support portion includes spaced members of substantially C-shape;
(b) each said C-shaped member having a recess through which a first part of the bolt is inserted for positioning within said spaced members, and
(c) said bolt retaining member for said movable support portion includes a substantially C-shaped member;
(d) said C-shaped member for said movable support portion having a recess through which a second part of the bolt is inserted.

3. The apparatus of claim 2, with the addition of
(a) an inverted U-shaped member including spaced legs connected at their upper end by a transverse portion, the lower ends of the legs being fixed to said bolt retaining members of said stationary support portion, thereby forming a handgrip to facilitate movement of the apparatus from place to place.

4. The apparatus of claim 1, wherein
(a) said power cylinder and piston are hydraulically actuated.

5. The apparatus of claim 4, wherein
(a) said power cylinder and piston is operatively connected with the hydraulic power source of a bolting machine.

6. The apparatus of claim 1, with the addition of
(a) a jack operatively connected with said apparatus for raising the latter to facilitate insertion of the bent portion of the roof bolt into a mine roof opening.

7. The apparatus of claim 1, wherein
(a) said jack includes a ground-engaging base;
(b) a stanchion mounted on said base and extending upwardly therefrom;
(c) a lifting member slidably mounted on said stanchion;
(d) a first means for locking said lifting member at selected points along the length of said stanchion, and
(e) a second means for fixedly connecting said lifting member to the base of said triangular shaped movable support portion, whereby, when the base of said jack is in engagement with the ground, the bent portion of the bolt extends upwardly for insertion into the mine roof opening, said jack being swung out of engagement with the ground upon deactivation of said power cylinder to straighten the bolt for insertion thereof into the mine roof opening.

* * * * *